US011267096B2

(12) United States Patent
Novovic et al.

(10) Patent No.: US 11,267,096 B2
(45) Date of Patent: Mar. 8, 2022

(54) MANUFACTURING METHOD

(71) Applicant: ROLLS-ROYCE plc, London (GB)

(72) Inventors: Donka Novovic, Birmingham (GB); James Kelsey, Sheffield (GB); David T. Curtis, Sheffield (GB)

(73) Assignee: Rolls-Royce plc, London (GB)

( * ) Notice: Subject to any disclaimer, the term of this patent is extended or adjusted under 35 U.S.C. 154(b) by 119 days.

(21) Appl. No.: 16/691,655

(22) Filed: Nov. 22, 2019

(65) Prior Publication Data

US 2020/0189063 A1 Jun. 18, 2020

(30) Foreign Application Priority Data

Dec. 13, 2018 (GB) ..... 1820302

(51) Int. Cl.
*B24B 19/14* (2006.01)

(52) U.S. Cl.
CPC ..... *B24B 19/14* (2013.01)

(58) Field of Classification Search
CPC ..... B24B 19/14; B24B 19/09
See application file for complete search history.

(56) References Cited

U.S. PATENT DOCUMENTS 5,042,204 A * 8/1991 Johnson ..... B24B 19/09 451/307
5,339,521 A 8/1994 Kawase

FOREIGN PATENT DOCUMENTS

DE 102010029445 12/2011
EP 0336312 10/1989
EP 2623644 8/2013

OTHER PUBLICATIONS

GRZ Software Blog. How to Choose a Stepover. Retrieved from http://www.grzsoftware.com/blog/how-to/choose-stepover/ on Nov. 8, 2019.
Harvey Performance Company, LLC (Jun. 28, 2017). Intro to Trochoidal Milling [Blog post]. Retrieved from https://www.harveyperformance.com/in-the-loupe/introduction-trochoidal-milling/ retrieved on Nov. 13, 2019.
WIDIA Product Group. Trochoidal Milling. Retrieved from https://www.widia.com/en/featured/trochoidal-milling.html on Nov. 13, 2019.
Great Britain search report dated Jun. 12, 2019, issued in GB Patent Application No. 1820302.6.
Harvey Performance Company, Diving Into Depth of Cut: Peripheral, Slotting, & HEM Approaches, in the Loupe Machinist Blog (Blog Post), Dated Jun. 15, 2017, pp. 1-10, Harvey Performance Company, LLC, Available at https://www.harveyperformance.com/in-the-loupe/depth-of-cut/.

* cited by examiner

*Primary Examiner* — Moshe Wilensky
(74) *Attorney, Agent, or Firm* — Crowell & Moring LLP

(57) ABSTRACT

A method of manufacturing a component is provided. The method includes performing a machining operation by moving a rotating, abrasive grinding tool along a feed direction to remove material from the component. At least the part of the component from which the material is removed is formed of composite material. The abrasive grinding tool follows a trochoidal path along the feed direction.

7 Claims, 4 Drawing Sheets

MANUFACTURING METHOD

CROSS-REFERENCE TO RELATED APPLICATIONS

This application is based upon and claims the benefit of priority from UK Patent Application Number GB1820302.6 filed on 13 Dec. 2018, the entire contents of which are incorporated herein by reference.

BACKGROUND

Technical Field

The present disclosure relates to a method of manufacturing a component.

Description of the Related Art

Composite materials are increasingly used in aero gas turbine engines due to their generally attractive combinations of properties such as high strength and low weight. For example, carbon fibre composites (CFCs) may be used to form fan cases and fan blades. As another example, ceramic matrix composites (CMCs) are proposed for forming turbine section components, such as turbine blades, nozzle guide vanes, seal segments, and seal rings, CMCs providing high temperature capabilities which are as good as if not better than conventional superalloys, as well as aforementioned strength and weight benefits. In particular, CMC can have about one third the density of superalloys.

A problem arises, however, in that composite materials can be difficult to machine with conventional chip-forming cutting methods, such as milling and turning. Thus where a composite material has a laminar structure formed from a build-up of plies, the structure can be sensitive to cutting forces in the plane of the lamellae which may cause delamination, and cutting forces normal to the lamellae which can cause cracking, entry/exit chipping and fibre damage. Accordingly, conventional cutting methods may have to apply gentle cutting condition in order to keep cutting forces low. This can result in low efficiencies and low material removal rates while still carrying risks of part movement within fixture, dimensional variability, delamination, edge chipping, fibre damage etc.

It would be desirable to provide an improved approach for machining composite materials.

SUMMARY

Accordingly, there is provided a method of manufacturing a component, the method including:

performing a machining operation by moving a rotating, abrasive grinding tool along a feed direction to remove material from the component;

wherein at least the part of the component from which the material is removed is formed of composite material, and wherein the abrasive grinding tool follows a trochoidal path along the feed direction.

Advantageously, by adopting the trochoidal path, due to a reduced radial depth of cut, machining forces and machining temperatures can be reduced, thereby improving component dimensional quality, and the risks of delamination, chipping, fibre damage etc. can be reduced. At the same time, by utilisation of a high rotation speed, a high and changing feed rate (helping to maintain a constant maximum chip thickness/chip load) and a high axial depth of cut, overall machining rates and tool life can be increased, reducing cycle times and costs. In addition, the abrasive nature of the tool (with multiple micro-cutting edges) is beneficial for machining ceramic materials, which, due to a generally low ductility and high hardness are difficult to machine by conventional chip-forming methods.

Optional features of the present disclosure will now be set out. These are applicable singly or in any combination with any aspect of the present disclosure.

The trochoidal path may lie in a plane and the abrasive grinding tool may rotate about a rotation axis which is perpendicular to the plane.

The rotation of the abrasive grinding tool may be directed such that the surface of the tool in contact with the component rotates towards the most recently cut surface of the component. In this way, evacuation of chips can be facilitated, cutting fluid access can be improved and delamination of the composite material can be reduced.

The composite material may be a ceramic matrix composite material, such as a silicon carbide-silicon carbide composite or an oxide-oxide (e.g. $Al_2O_3$—$Al_2O_3$) composite. Such composites can be formed using techniques such as polymer impregnation and pyrolysis, or chemical vapour melt infiltration or infiltration to infiltrate matrix ceramic into a fibrous or whisker-based preform. Other techniques are also known to the skilled person.

To further protect the surface of the component, the method may further include encapsulating the component in an encapsulant before performing the machining operation. For example, a suitable encapsulant may be wax or glass fibre reinforced plastic. The method may then include removing the encapsulant after performing the machining operation. However, in general, as an advantage of the method is that is can reduce the risks of delamination, chipping, fibre damage etc., the method may be performed without any encapsulant, thereby reducing costs and process times.

The trochoidal path may contain loops having a loop radius r which in terms of the tool diameter d of the abrasive grinding tool preferably has a value which, to within ±10%, is determined by the expression:

$$r = \left(\left(\frac{d}{0.7}\right) - d\right)0.5$$

The abrasive grinding tool may be a grinding wheel or pin.

The trochoidal path may have a step over t, which is the distance in the feed direction between two equivalent points on adjacent loops of the trochoidal path, such that:

$$t < \sqrt{\left(\frac{d}{2}\right)^2 - \left(\left(\frac{d}{2}\right) - ae\right)^2} - \sqrt{\left(\left(\frac{d}{2}\right) - g\right)^2 - \left(\left(\frac{d}{2}\right) - ae\right)^2}$$

where d is the diameter of the tool, ae is the depth of cut made by the tool, and g is the maximum distance by which abrasive grit particles protrude from the surface of the tool.

The machining operation may include forming a slot in the component. For example, the slot may extend across a full thickness of the component. In order that the tool can follow an effective trochoidal path in the slot, preferably:

$$d<0.7w$$

where d is the diameter of the tool and w is the width of the slot measured perpendicularly to the feed direction. Additionally or alternatively, it is preferred that:

$$d>0.5w$$

The slot width w may be 2 mm or more, and/or 60 mm or less. Although feasible to use for slot widths of less than 2 mm, the tool may have insufficient strength; while for machining slots having widths of more than 60 mm, different manufacturing methods may be more appropriate.

The machining operation may include removing an external face of the component.

More generally, whether a slot or an external face is being machined, the machined surface(s) (i.e. the sides of the slot or the external face) do not need to be straight and can follow a curved profile.

The component may be a component of a gas turbine engine. For example, it may be a turbine section component, such as a seal segment, a seal ring, a nozzle guide vane, or a turbine blade. In particular, the component may be a seal segment of a gas turbine engine, and the machining operation may form a groove in the seal segment.

As noted elsewhere herein, the present disclosure may relate to a gas turbine engine. Such a gas turbine engine may comprise an engine core comprising a turbine, a combustor, a compressor, and a core shaft connecting the turbine to the compressor. Such a gas turbine engine may comprise a fan (having fan blades) located upstream of the engine core.

Arrangements of the present disclosure may be particularly, although not exclusively, beneficial for fans that are driven via a gearbox. Accordingly, the gas turbine engine may comprise a gearbox that receives an input from the core shaft and outputs drive to the fan so as to drive the fan at a lower rotational speed than the core shaft. The input to the gearbox may be directly from the core shaft, or indirectly from the core shaft, for example via a spur shaft and/or gear. The core shaft may rigidly connect the turbine and the compressor, such that the turbine and compressor rotate at the same speed (with the fan rotating at a lower speed).

The gas turbine engine as described and/or claimed herein may have any suitable general architecture. For example, the gas turbine engine may have any desired number of shafts that connect turbines and compressors, for example one, two or three shafts. Purely by way of example, the turbine connected to the core shaft may be a first turbine, the compressor connected to the core shaft may be a first compressor, and the core shaft may be a first core shaft. The engine core may further comprise a second turbine, a second compressor, and a second core shaft connecting the second turbine to the second compressor. The second turbine, second compressor, and second core shaft may be arranged to rotate at a higher rotational speed than the first core shaft.

In such an arrangement, the second compressor may be positioned axially downstream of the first compressor. The second compressor may be arranged to receive (for example directly receive, for example via a generally annular duct) flow from the first compressor.

The gearbox may be arranged to be driven by the core shaft that is configured to rotate (for example in use) at the lowest rotational speed (for example the first core shaft in the example above). For example, the gearbox may be arranged to be driven only by the core shaft that is configured to rotate (for example in use) at the lowest rotational speed (for example only be the first core shaft, and not the second core shaft, in the example above). Alternatively, the gearbox may be arranged to be driven by any one or more shafts, for example the first and/or second shafts in the example above.

The gearbox may be a reduction gearbox (in that the output to the fan is a lower rotational rate than the input from the core shaft). Any type of gearbox may be used. For example, the gearbox may be a "planetary" or "star" gearbox, as described in more detail elsewhere herein. The gearbox may have any desired reduction ratio (defined as the rotational speed of the input shaft divided by the rotational speed of the output shaft), for example greater than 2.5, for example in the range of from 3 to 4.2, or 3.2 to 3.8, for example on the order of or at least 3, 3.1, 3.2, 3.3, 3.4, 3.5, 3.6, 3.7, 3.8, 3.9, 4, 4.1 or 4.2. The gear ratio may be, for example, between any two of the values in the previous sentence. Purely by way of example, the gearbox may be a "star" gearbox having a ratio in the range of from 3.1 or 3.2 to 3.8. In some arrangements, the gear ratio may be outside these ranges.

In any gas turbine engine as described and/or claimed herein, a combustor may be provided axially downstream of the fan and compressor(s). For example, the combustor may be directly downstream of (for example at the exit of) the second compressor, where a second compressor is provided. By way of further example, the flow at the exit to the combustor may be provided to the inlet of the second turbine, where a second turbine is provided. The combustor may be provided upstream of the turbine(s).

The or each compressor (for example the first compressor and second compressor as described above) may comprise any number of stages, for example multiple stages. Each stage may comprise a row of rotor blades and a row of stator vanes, which may be variable stator vanes (in that their angle of incidence may be variable). The row of rotor blades and the row of stator vanes may be axially offset from each other.

The or each turbine (for example the first turbine and second turbine as described above) may comprise any number of stages, for example multiple stages. Each stage may comprise a row of rotor blades and a row of stator vanes. The row of rotor blades and the row of stator vanes may be axially offset from each other.

Each fan blade may be defined as having a radial span extending from a root (or hub) at a radially inner gas-washed location, or 0% span position, to a tip at a 100% span position. The ratio of the radius of the fan blade at the hub to the radius of the fan blade at the tip may be less than (or on the order of) any of: 0.4, 0.39, 0.38, 0.37, 0.36, 0.35, 0.34, 0.33, 0.32, 0.31, 0.3, 0.29, 0.28, 0.27, 0.26, or 0.25. The ratio of the radius of the fan blade at the hub to the radius of the fan blade at the tip may be in an inclusive range bounded by any two of the values in the previous sentence (i.e. the values may form upper or lower bounds), for example in the range of from 0.28 to 0.32. These ratios may commonly be referred to as the hub-to-tip ratio. The radius at the hub and the radius at the tip may both be measured at the leading edge (or axially forwardmost) part of the blade. The hub-to-tip ratio refers, of course, to the gas-washed portion of the fan blade, i.e. the portion radially outside any platform.

The radius of the fan may be measured between the engine centreline and the tip of a fan blade at its leading edge.

The fan diameter (which may simply be twice the radius of the fan) may be greater than (or on the order of) any of: 220 cm, 230 cm, 240 cm, 250 cm (around 100 inches), 260 cm, 270 cm (around 105 inches), 280 cm (around 110 inches), 290 cm (around 115 inches), 300 cm (around 120 inches), 310 cm, 320 cm (around 125 inches), 330 cm (around 130 inches), 340 cm (around 135 inches), 350 cm, 360 cm (around 140 inches), 370 cm (around 145 inches), 380 (around 150 inches) cm, 390 cm (around 155 inches), 400 cm, 410 cm (around 160 inches) or 420 cm (around 165 inches). The fan diameter may be in an inclusive range bounded by any two of the values in the previous sentence (i.e. the values may form upper or lower bounds), for example in the range of from 240 cm to 280 cm or 330 cm to 380 cm.

The rotational speed of the fan may vary in use. Generally, the rotational speed is lower for fans with a higher diameter. Purely by way of non-limitative example, the rotational speed of the fan at cruise conditions may be less than 2500 rpm, for example less than 2300 rpm. Purely by way of further non-limitative example, the rotational speed of the fan at cruise conditions for an engine having a fan diameter in the range of from 220 cm to 300 cm (for example 240 cm to 280 cm or 250 cm to 270 cm) may be in the range of from 1700 rpm to 2500 rpm, for example in the range of from 1800 rpm to 2300 rpm, for example in the range of from 1900 rpm to 2100 rpm. Purely by way of further non-limitative example, the rotational speed of the fan at cruise conditions for an engine having a fan diameter in the range of from 330 cm to 380 cm may be in the range of from 1200 rpm to 2000 rpm, for example in the range of from 1300 rpm to 1800 rpm, for example in the range of from 1400 rpm to 1800 rpm.

In use of the gas turbine engine, the fan (with associated fan blades) rotates about a rotational axis. This rotation results in the tip of the fan blade moving with a velocity $U_{tip}$. The work done by the fan blades 13 on the flow results in an enthalpy rise dH of the flow. A fan tip loading may be defined as $dH/U_{tip}^2$, where dH is the enthalpy rise (for example the 1-D average enthalpy rise) across the fan and $U_{tip}$ is the (translational) velocity of the fan tip, for example at the leading edge of the tip (which may be defined as fan tip radius at leading edge multiplied by angular speed). The fan tip loading at cruise conditions may be greater than (or on the order of) any of: 0.28, 0.29, 0.30, 0.31, 0.32, 0.33, 0.34, 0.35, 0.36, 0.37, 0.38, 0.39 or 0.4 (all values being dimensionless). The fan tip loading may be in an inclusive range bounded by any two of the values in the previous sentence (i.e. the values may form upper or lower bounds), for example in the range of from 0.28 to 0.31, or 0.29 to 0.3.

Gas turbine engines in accordance with the present disclosure may have any desired bypass ratio, where the bypass ratio is defined as the ratio of the mass flow rate of the flow through the bypass duct to the mass flow rate of the flow through the core at cruise conditions. In some arrangements the bypass ratio may be greater than (or on the order of) any of the following: 10, 10.5, 11, 11.5, 12, 12.5, 13, 13.5, 14, 14.5, 15, 15.5, 16, 16.5, 17, 17.5, 18, 18.5, 19, 19.5 or 20. The bypass ratio may be in an inclusive range bounded by any two of the values in the previous sentence (i.e. the values may form upper or lower bounds), for example in the range of form 12 to 16, 13 to 15, or 13 to 14. The bypass duct may be substantially annular. The bypass duct may be radially outside the core engine. The radially outer surface of the bypass duct may be defined by a nacelle and/or a fan case.

The overall pressure ratio of a gas turbine engine as described and/or claimed herein may be defined as the ratio of the stagnation pressure upstream of the fan to the stagnation pressure at the exit of the highest pressure compressor (before entry into the combustor). By way of non-limitative example, the overall pressure ratio of a gas turbine engine as described and/or claimed herein at cruise may be greater than (or on the order of) any of the following: 35, 40, 45, 50, 55, 60, 65, 70, 75. The overall pressure ratio may be in an inclusive range bounded by any two of the values in the previous sentence (i.e. the values may form upper or lower bounds), for example in the range of from 50 to 70.

Specific thrust of an engine may be defined as the net thrust of the engine divided by the total mass flow through the engine. At cruise conditions, the specific thrust of an engine described and/or claimed herein may be less than (or on the order of) any of the following: 110 $Nkg^{-1}s$, 105 $Nkg^{-1}s$, 100 $Nkg^{-1}s$, 95 $Nkg^{-1}s$, 90 $Nkg^{-1}s$, 85 $Nkg^{-1}s$ or 80 $Nkg^{-1}s$. The specific thrust may be in an inclusive range bounded by any two of the values in the previous sentence (i.e. the values may form upper or lower bounds), for example in the range of from 80 $Nkg^{-1}s$ to 100 $Nkg^{-1}s$, or 85 $Nkg^{-1}s$ to 95 $Nkg^{-1}s$. Such engines may be particularly efficient in comparison with conventional gas turbine engines.

A gas turbine engine as described and/or claimed herein may have any desired maximum thrust. Purely by way of non-limitative example, a gas turbine as described and/or claimed herein may be capable of producing a maximum thrust of at least (or on the order of) any of the following: 160 kN, 170 kN, 180 kN, 190 kN, 200 kN, 250 kN, 300 kN, 350 kN, 400 kN, 450 kN, 500 kN, or 550 kN. The maximum thrust may be in an inclusive range bounded by any two of the values in the previous sentence (i.e. the values may form upper or lower bounds). Purely by way of example, a gas turbine as described and/or claimed herein may be capable of producing a maximum thrust in the range of from 330 kN to 420 kN, for example 350 kN to 400 kN. The thrust referred to above may be the maximum net thrust at standard atmospheric conditions at sea level plus 15 degrees C. (ambient pressure 101.3 kPa, temperature 30 degrees C.), with the engine static.

In use, the temperature of the flow at the entry to the high pressure turbine may be particularly high. This temperature, which may be referred to as TET, may be measured at the exit to the combustor, for example immediately upstream of the first turbine vane, which itself may be referred to as a nozzle guide vane. At cruise, the TET may be at least (or on the order of) any of the following: 1400K, 1450K, 1500K, 1550K, 1600K or 1650K. The TET at cruise may be in an inclusive range bounded by any two of the values in the previous sentence (i.e. the values may form upper or lower bounds). The maximum TET in use of the engine may be, for example, at least (or on the order of) any of the following: 1700K, 1750K, 1800K, 1850K, 1900K, 1950K or 2000K. The maximum TET may be in an inclusive range bounded by any two of the values in the previous sentence (i.e. the values may form upper or lower bounds), for example in the range of from 1800K to 1950K. The maximum TET may occur, for example, at a high thrust condition, for example at a maximum take-off (MTO) condition.

A fan blade and/or aerofoil portion of a fan blade described and/or claimed herein may be manufactured from any suitable material or combination of materials. For example at least a part of the fan blade and/or aerofoil may be manufactured at least in part from a composite, for example a metal matrix composite and/or an organic matrix composite, such as carbon fibre. By way of further example at least a part of the fan blade and/or aerofoil may be manufactured at least in part from a metal, such as a titanium based metal or an aluminium based material (such as an aluminium-lithium alloy) or a steel based material. The fan blade may comprise at least two regions manufactured using different materials. For example, the fan blade may have a protective leading edge, which may be manufactured using a material that is better able to resist impact (for example from birds, ice or other material) than the rest of the blade. Such a leading edge may, for example, be manufactured using titanium or a titanium-based alloy. Thus, purely by way of example, the fan blade may have a carbon-fibre or aluminium based body (such as an aluminium lithium alloy) with a titanium leading edge.

A fan as described and/or claimed herein may comprise a central portion, from which the fan blades may extend, for example in a radial direction. The fan blades may be attached to the central portion in any desired manner. For example, each fan blade may comprise a fixture which may engage a corresponding slot in the hub (or disc). Purely by way of example, such a fixture may be in the form of a dovetail that may slot into and/or engage a corresponding slot in the hub/disc in order to fix the fan blade to the hub/disc. By way of further example, the fan blades may be formed integrally with a central portion. Such an arrangement may be referred to as a bladed disc or a bladed ring. Any suitable method may be used to manufacture such a bladed disc or bladed ring. For example, at least a part of the fan blades may be machined from a block and/or at least part of the fan blades may be attached to the hub/disc by welding, such as linear friction welding.

The gas turbine engines described and/or claimed herein may or may not be provided with a variable area nozzle (VAN). Such a variable area nozzle may allow the exit area of the bypass duct to be varied in use. The general principles of the present disclosure may apply to engines with or without a VAN. The fan of a gas turbine as described and/or claimed herein may have any desired number of fan blades, for example 14, 16, 18, 20, 22, 24 or 26 fan blades.

As used herein, cruise conditions have the conventional meaning and would be readily understood by the skilled person. Thus, for a given gas turbine engine for an aircraft, the skilled person would immediately recognise cruise conditions to mean the operating point of the engine at mid-cruise of a given mission (which may be referred to in the industry as the "economic mission") of an aircraft to which the gas turbine engine is designed to be attached. In this regard, mid-cruise is the point in an aircraft flight cycle at which 50% of the total fuel that is burned between top of climb and start of descent has been burned (which may be approximated by the midpoint—in terms of time and/or distance—between top of climb and start of descent. Cruise conditions thus define an operating point of the gas turbine engine that provides a thrust that would ensure steady state operation (i.e. maintaining a constant altitude and constant Mach Number) at mid-cruise of an aircraft to which it is designed to be attached, taking into account the number of engines provided to that aircraft. For example where an engine is designed to be attached to an aircraft that has two engines of the same type, at cruise conditions the engine provides half of the total thrust that would be required for steady state operation of that aircraft at mid-cruise.

In other words, for a given gas turbine engine for an aircraft, cruise conditions are defined as the operating point of the engine that provides a specified thrust (required to provide—in combination with any other engines on the aircraft—steady state operation of the aircraft to which it is designed to be attached at a given mid-cruise Mach Number) at the mid-cruise atmospheric conditions (defined by the International Standard Atmosphere according to ISO 2533 at the mid-cruise altitude). For any given gas turbine engine for an aircraft, the mid-cruise thrust, atmospheric conditions and Mach Number are known, and thus the operating point of the engine at cruise conditions is clearly defined.

Purely by way of example, the forward speed at the cruise condition may be any point in the range of from Mach 0.7 to 0.9, for example 0.75 to 0.85, for example 0.76 to 0.84, for example 0.77 to 0.83, for example 0.78 to 0.82, for example 0.79 to 0.81, for example on the order of Mach 0.8, on the order of Mach 0.85 or in the range of from 0.8 to 0.85. Any single speed within these ranges may be part of the cruise condition. For some aircraft, the cruise conditions may be outside these ranges, for example below Mach 0.7 or above Mach 0.9.

Purely by way of example, the cruise conditions may correspond to standard atmospheric conditions (according to the International Standard Atmosphere, ISA) at an altitude that is in the range of from 10000 m to 15000 m, for example in the range of from 10000 m to 12000 m, for example in the range of from 10400 m to 11600 m (around 38000 ft), for example in the range of from 10500 m to 11500 m, for example in the range of from 10600 m to 11400 m, for example in the range of from 10700 m (around 35000 ft) to 11300 m, for example in the range of from 10800 m to 11200 m, for example in the range of from 10900 m to 11100 m, for example on the order of 11000 m. The cruise conditions may correspond to standard atmospheric conditions at any given altitude in these ranges.

Purely by way of example, the cruise conditions may correspond to an operating point of the engine that provides a known required thrust level (for example a value in the range of from 30 kN to 35 kN) at a forward Mach number of 0.8 and standard atmospheric conditions (according to the International Standard Atmosphere) at an altitude of 38000 ft (11582 m). Purely by way of further example, the cruise conditions may correspond to an operating point of the engine that provides a known required thrust level (for example a value in the range of from 50 kN to 65 kN) at a forward Mach number of 0.85 and standard atmospheric conditions (according to the International Standard Atmosphere) at an altitude of 35000 ft (10668 m).

In use, a gas turbine engine described and/or claimed herein may operate at the cruise conditions defined elsewhere herein. Such cruise conditions may be determined by the cruise conditions (for example the mid-cruise conditions) of an aircraft to which at least one (for example 2 or 4) gas turbine engine may be mounted in order to provide propulsive thrust.

According to an aspect, there is provided an aircraft comprising a gas turbine engine as described and/or claimed herein. The aircraft according to this aspect is the aircraft for which the gas turbine engine has been designed to be attached. Accordingly, the cruise conditions according to this aspect correspond to the mid-cruise of the aircraft, as defined elsewhere herein.

According to an aspect, there is provided a method of operating a gas turbine engine as described and/or claimed herein. The operation may be at the cruise conditions as defined elsewhere herein (for example in terms of the thrust, atmospheric conditions and Mach Number).

According to an aspect, there is provided a method of operating an aircraft comprising a gas turbine engine as described and/or claimed herein. The operation according to this aspect may include (or may be) operation at the mid-cruise of the aircraft, as defined elsewhere herein.

The skilled person will appreciate that except where mutually exclusive, a feature or parameter described in relation to any one of the above aspects may be applied to any other aspect. Furthermore, except where mutually exclusive, any feature or parameter described herein may be applied to any aspect and/or combined with any other feature or parameter described herein.

DESCRIPTION OF THE DRAWINGS

Embodiments will now be described by way of example only, with reference to the Figures, in which.

DETAILED DESCRIPTION

Figure 1:
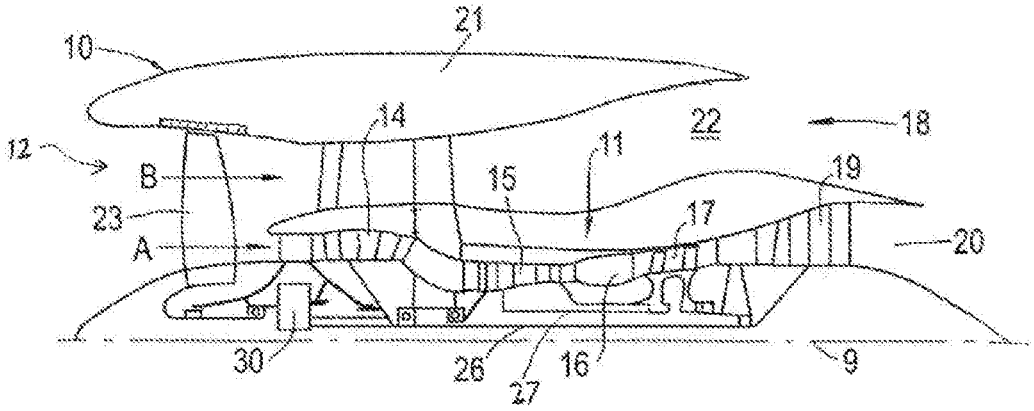
FIG. 1 is a sectional side view of a gas turbine engine.

FIG. 1 illustrates a gas turbine engine 10 having a principal rotational axis 9. The engine 10 comprises an air intake 12 and a propulsive fan 23 that generates two airflows: a core airflow A and a bypass airflow B. The gas turbine engine 10 comprises a core 11 that receives the core airflow A. The engine core 11 comprises, in axial flow series, a low pressure compressor 14, a high-pressure compressor 15, combustion equipment 16, a high-pressure turbine 17, a low pressure turbine 19 and a core exhaust nozzle 20. A nacelle 21 surrounds the gas turbine engine 10 and defines a bypass duct 22 and a bypass exhaust nozzle 18. The bypass airflow B flows through the bypass duct 22. The fan 23 is attached to and driven by the low pressure turbine 19 via a shaft 26 and an epicyclic gearbox 30.

In use, the core airflow A is accelerated and compressed by the low pressure compressor 14 and directed into the high pressure compressor 15 where further compression takes place. The compressed air exhausted from the high pressure compressor 15 is directed into the combustion equipment 16 where it is mixed with fuel and the mixture is combusted. The resultant hot combustion products then expand through, and thereby drive, the high pressure and low pressure turbines 17, 19 before being exhausted through the nozzle 20 to provide some propulsive thrust. The high pressure turbine 17 drives the high pressure compressor 15 by a suitable interconnecting shaft 27. The fan 23 generally provides the majority of the propulsive thrust. The epicyclic gearbox 30 is a reduction gearbox.

Figure 2:
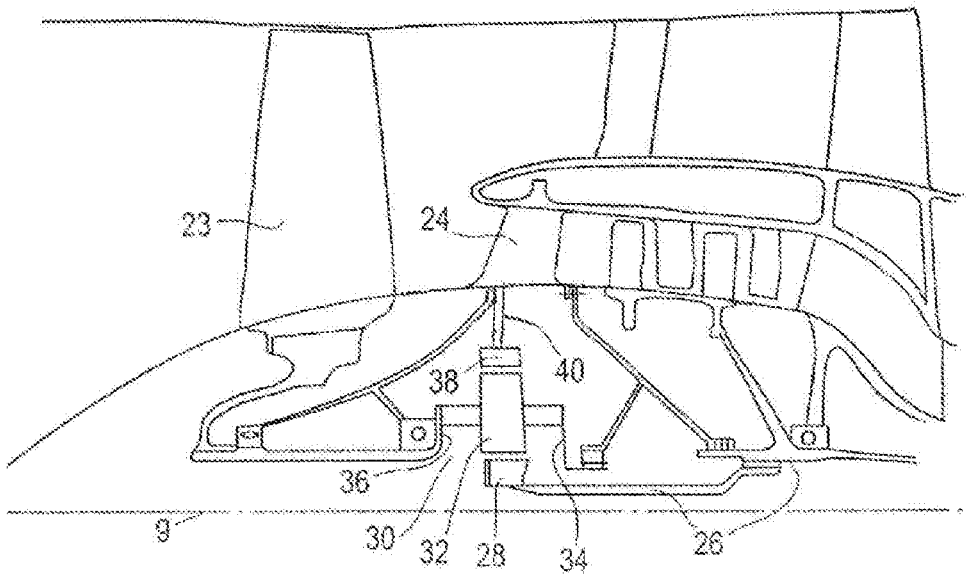
FIG. 2 is a close up sectional side view of an upstream portion of a gas turbine engine.

An exemplary arrangement for a geared fan gas turbine engine 10 is shown in FIG. 2. The low pressure turbine 19 (see FIG. 1) drives the shaft 26, which is coupled to a sun wheel, or sun gear, 28 of the epicyclic gear arrangement 30. Radially outwardly of the sun gear 28 and intermeshing therewith is a plurality of planet gears 32 that are coupled together by a planet carrier 34. The planet carrier 34 constrains the planet gears 32 to precess around the sun gear 28 in synchronicity whilst enabling each planet gear 32 to rotate about its own axis. The planet carrier 34 is coupled via linkages 36 to the fan 23 in order to drive its rotation about the engine axis 9. Radially outwardly of the planet gears 32 and intermeshing therewith is an annulus or ring gear 38 that is coupled, via linkages 40, to a stationary supporting structure 24.

Note that the terms "low pressure turbine" and "low pressure compressor" as used herein may be taken to mean the lowest pressure turbine stages and lowest pressure compressor stages (i.e. not including the fan 23) respectively and/or the turbine and compressor stages that are connected together by the interconnecting shaft 26 with the lowest rotational speed in the engine (i.e. not including the gearbox output shaft that drives the fan 23). In some literature, the "low pressure turbine" and "low pressure compressor" referred to herein may alternatively be known as the "intermediate pressure turbine" and "intermediate pressure compressor". Where such alternative nomenclature is used, the fan 23 may be referred to as a first, or lowest pressure, compression stage.

Figure 3:
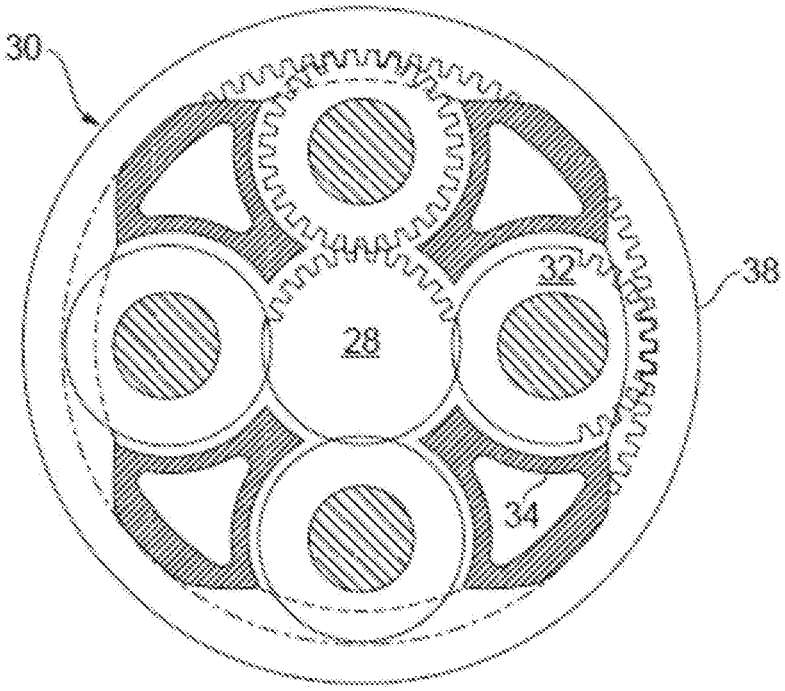
FIG. 3 is a partially cut-away view of a gearbox for a gas turbine engine.

The epicyclic gearbox 30 is shown by way of example in greater detail in FIG. 3. Each of the sun gear 28, planet gears 32 and ring gear 38 comprise teeth about their periphery to intermesh with the other gears. However, for clarity only exemplary portions of the teeth are illustrated in FIG. 3. There are four planet gears 32 illustrated, although it will be apparent to the skilled reader that more or fewer planet gears 32 may be provided within the scope of the present disclosure. Practical applications of a planetary epicyclic gearbox 30 generally comprise at least three planet gears 32.

The epicyclic gearbox 30 illustrated by way of example in FIGS. 2 and 3 is of the planetary type, in that the planet carrier 34 is coupled to an output shaft via linkages 36, with the ring gear 38 fixed. However, any other suitable type of epicyclic gearbox 30 may be used. By way of further example, the epicyclic gearbox 30 may be a star arrangement, in which the planet carrier 34 is held fixed, with the ring (or annulus) gear 38 allowed to rotate. In such an arrangement the fan 23 is driven by the ring gear 38. By way of further alternative example, the gearbox 30 may be a differential gearbox in which the ring gear 38 and the planet carrier 34 are both allowed to rotate.

It will be appreciated that the arrangement shown in FIGS. 2 and 3 is by way of example only, and various alternatives are within the scope of the present disclosure. Purely by way of example, any suitable arrangement may be used for locating the gearbox 30 in the engine 10 and/or for connecting the gearbox 30 to the engine 10. By way of further example, the connections (such as the linkages 36, 40 in the FIG. 2 example) between the gearbox 30 and other parts of the engine 10 (such as the input shaft 26, the output shaft and the fixed structure 24) may have any desired degree of stiffness or flexibility. By way of further example, any suitable arrangement of the bearings between rotating and stationary parts of the engine (for example between the input and output shafts from the gearbox and the fixed structures, such as the gearbox casing) may be used, and the disclosure is not limited to the exemplary arrangement of FIG. 2. For example, where the gearbox 30 has a star arrangement (described above), the skilled person would readily understand that the arrangement of output and support linkages and bearing locations would typically be different to that shown by way of example in FIG. 2.

Accordingly, the present disclosure extends to a gas turbine engine having any arrangement of gearbox styles (for example star or planetary), support structures, input and output shaft arrangement, and bearing locations.

Optionally, the gearbox may drive additional and/or alternative components (e.g. the intermediate pressure compressor and/or a booster compressor).

Other gas turbine engines to which the present disclosure may be applied may have alternative configurations. For example, such engines may have an alternative number of compressors and/or turbines and/or an alternative number of interconnecting shafts. By way of further example, the gas turbine engine shown in FIG. 1 has a split flow nozzle 18, 20 meaning that the flow through the bypass duct 22 has its own nozzle 18 that is separate to and radially outside the core engine nozzle 20. However, this is not limiting, and any aspect of the present disclosure may also apply to engines in which the flow through the bypass duct 22 and the flow through the core 11 are mixed, or combined, before (or upstream of) a single nozzle, which may be referred to as a mixed flow nozzle. One or both nozzles (whether mixed or split flow) may have a fixed or variable area. Whilst the described example relates to a turbofan engine, the disclosure may apply, for example, to any type of gas turbine engine, such as an open rotor (in which the fan stage is not surrounded by a nacelle) or turboprop engine, for example. In some arrangements, the gas turbine engine 10 may not comprise a gearbox 30.

The geometry of the gas turbine engine 10, and components thereof, is defined by a conventional axis system, comprising an axial direction (which is aligned with the rotational axis 9), a radial direction (in the bottom-to-top direction in FIG. 1), and a circumferential direction (perpendicular to the page in the FIG. 1 view). The axial, radial and circumferential directions are mutually perpendicular.

Figure 4:
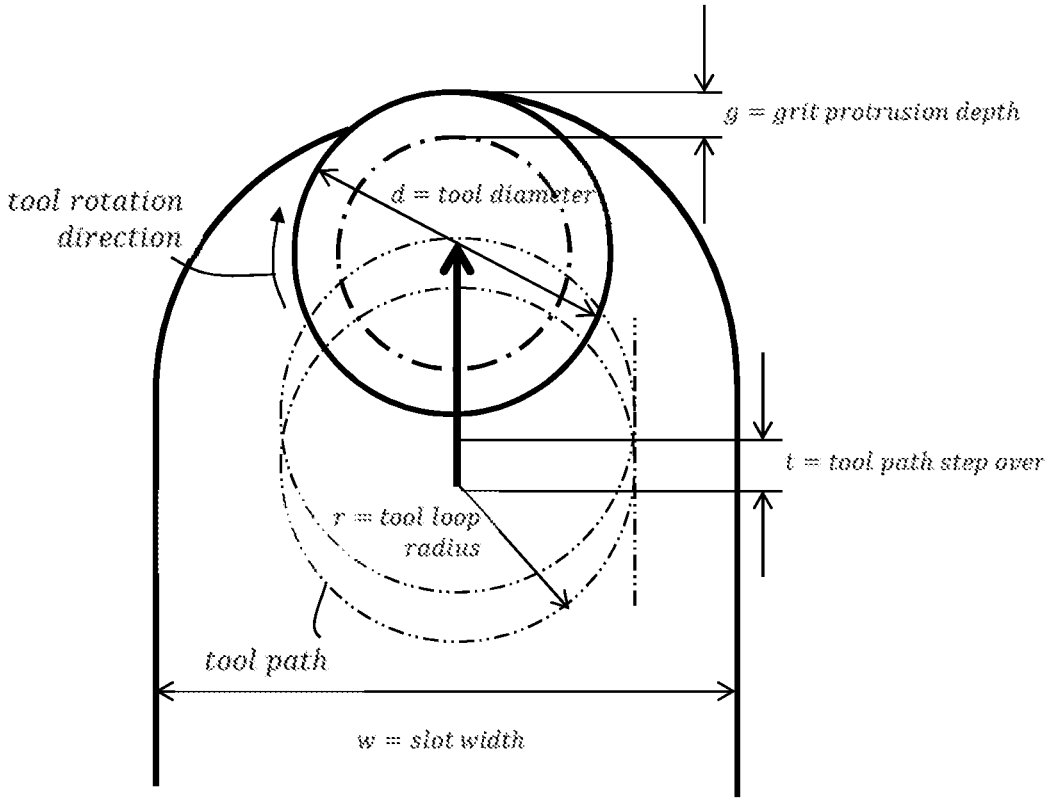
FIG. 4 shows schematically a slot being machined by trochoidal cutting using a rotating, abrasive grinding tool.
Figure 5:
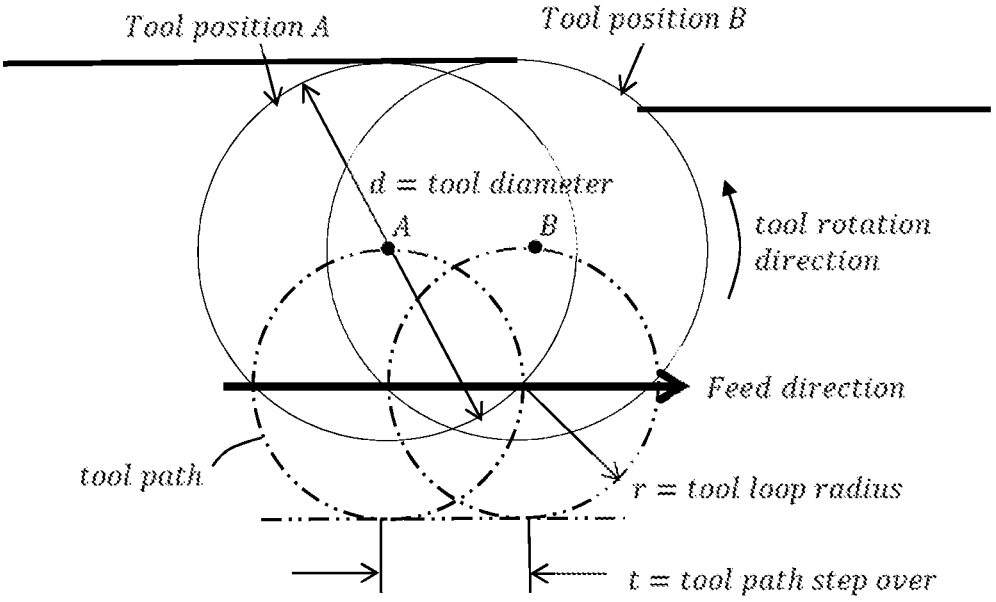
FIG. 5 shows schematically a flank being machined by trochoidal cutting using a rotating, abrasive grinding tool.

The turbine section of the engine has components such as seal segments, a seal rings, nozzle guide vanes, and/or turbine blades formed from CMC material. FIG. 4 shows schematically a slot in one of these components, e.g. a groove in a seal segment, being machined by trochoidal cutting using a rotating, abrasive grinding tool, such as a grinding wheel or pin. The trochoidal path of the tool results in the slot being cut with a width w which is greater than the diameter d of the tool. This width w is determined by d and the radius r of the loops of the tool on the trochoidal path. FIG. 5 shows by comparison trochoidal cutting along a flank of one of these components to remove surface material using the abrasive grinding tool. In the machining operation of FIG. 4 the direction of tool feed is the same as the direction of maximum depth of cut, while in that of FIG. 5 it is perpendicular to the direction of maximum depth of cut. Nonetheless in both operations similar considerations apply.

In particular, in both operations the tool moves along a feed direction (indicated by a bold arrowed line) having a trochoidal path, two loops of which are indicated in each of FIGS. 4 and 5 by dash-double dotted lines. This path is defined by a step over t which is the distance along the feed direction between two equivalent points on adjacent loops (i.e. points A and B in FIG. 5), and the radius r of the loops. The tool rotates around an axis which is perpendicular to the plane of the trochoidal path. The rotation direction of the tool is typically such that the surface of the tool in contact with the component rotates towards the most recently cut surface of the component. In this way chips can be preferentially evacuated in a rearward direction relative to the movement of the tool into the component, which assists chip removal. However, a further consideration for determining the rotation direction of the tool is to avoid inducing strong delamination-inducing forces in the composite material as a result of the tool rotation. In general the rearward evacuation of chips is compatible with this further consideration.

The trochoidal path produces a cycle of engagement and disengagement of the tool and the component surface being cut which helps to prevent overheating of the tool and the component. The cycle also facilitates chip evacuation and cutting fluid access.

In the slot cutting operation of FIG. 4, the width w of the slot determines a preferred upper limit for the tool diameter d in order that the tool can follow an effective trochoidal path. In particular, preferably:

$$d<0.7w$$

Additionally or alternatively, it is preferred that:

$$d>0.5w$$

Such a preferred upper and lower limits for the tool diameter d do not apply in the case of the flank cutting operation of FIG. 5. In respect of both these operations, however, there exists a preferred relationship between the tool diameter d and the path loop radius r. In particular, r may have a value which, to within ±10%, is determined by the expression:

$$r=\left(\left(\frac{d}{0.7}\right)-d\right)0.5$$

Figure 6:
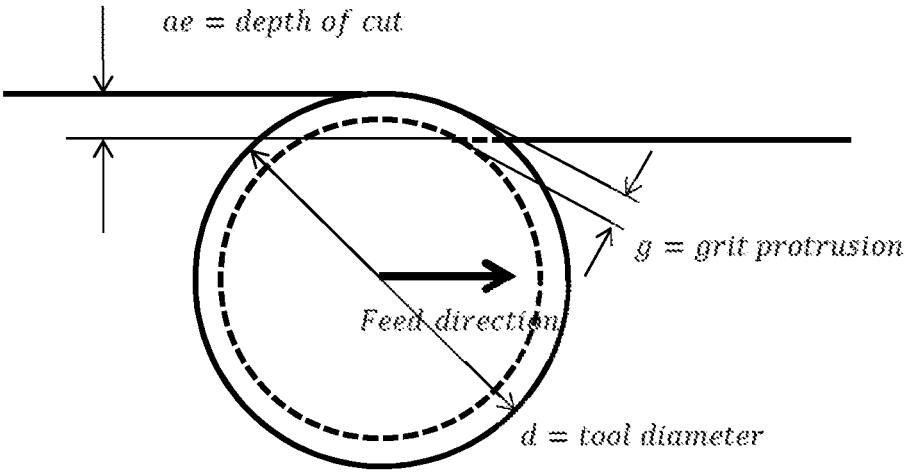
FIG. 6 illustrates parameters of the machining operations.

Moreover a preferred upper limit can be set on the path step over t dependent on the following parameters: the tool diameter d, the depth of cut ae, and the maximum distance g by which abrasive grit particles protrude from the surface of the tool, these parameters being illustrated in FIG. 6. Thus:

$$t<\sqrt{\left(\frac{d}{2}\right)^2-\left(\left(\frac{d}{2}\right)-ae\right)^2}-\sqrt{\left(\left(\frac{d}{2}\right)-g\right)^2-\left(\left(\frac{d}{2}\right)-ae\right)^2}$$

Advantages of performing the machining operations using a trochoidal path for the tool is that cutting forces can be reduced, chip evacuation improved, and the risks of overheating, delamination, chipping, fibre damage etc. can be reduced. Overall machining rates and tool life can also be increased, reducing cycle times and costs.

To reduce the likelihood of machining operations causing surface damage, a known approach is to encapsulate the component in a protective encapsulating material, such as wax or glass fibre reinforced plastic, prior to machining. The encapsulant can then be removed after the operation is completed. However, an advantage of the trochoidal grinding process is that it can eliminate the need for encapsulation.

Although described above in relation to machining of a CMC component, the method can also be applied to other composite material components, for example formed from polymer matrix composite materials (e.g. carbon fibre reinforced composite fan blades), or metal matric composite materials.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

We claim:

1. A method of manufacturing a component, the method including:

performing a machining operation by moving a rotating, abrasive grinding tool along a feed direction to remove material from the component;

wherein at least the part of the component from which the material is removed is formed of composite material, and wherein the abrasive grinding tool follows a trochoidal path along the feed direction, wherein the composite material is a ceramic matrix composite material, wherein the trochoidal path has a step over t, which is the distance in the feed direction between two equivalent points on adjacent loops of the trochoidal path, such that:

$$t < \sqrt{\left(\frac{d}{2}\right)^2 - \left(\left(\frac{d}{2}\right) - ae\right)^2} - \sqrt{\left(\left(\frac{d}{2}\right) - g\right)^2 - \left(\left(\frac{d}{2}\right) - ae\right)^2}$$

where d is the diameter of the tool, ae is the depth of cut made by the tool, and g is the maximum distance by which abrasive grit particles protrude from the surface of the tool, wherein the component is a seal segment of a gas turbine engine, and the machining operation forms a groove in the seal segment.

2. The method according to claim 1, wherein the trochoidal path lies in a plane and the abrasive grinding tool rotates about a rotation axis which is perpendicular to the plane.

3. The method according to claim 1, wherein the rotation of the abrasive grinding tool is directed such that the surface of the tool in contact with the component rotates towards the a most recently cut surface of the component.

4. The method according to claim 1, wherein the trochoidal path contains loops having a loop radius r, which in terms of the tool diameter d of the abrasive grinding tool has a value which, to within ±10%, is determined by the expression:

$$r = \left(\left(\frac{d}{0.7}\right) - d\right)0.5.$$

5. The method according to claim 1, wherein the machining operation includes forming a slot in the component.

6. The method according to claim 5, wherein:

$$d<0.7w$$

where d is the diameter of the tool and w is the width of the slot measured perpendicularly to the feed direction.

7. The method according to claim 1, wherein the machining operation includes removing an external face of the component.

* * * * *